US006450823B1

(12) United States Patent
Ichio et al.

(10) Patent No.: US 6,450,823 B1
(45) Date of Patent: Sep. 17, 2002

(54) WATERPROOF CONNECTOR

(75) Inventors: Toshifumi Ichio; Kouji Nemoto, both of Yokkaichi; Masanori Wakui, Toyota; Keiichi Itou, Toyota; Kazuyuki Shiraki, Toyota, all of (JP)

(73) Assignees: Sumitomo Wiring Systems, Ltd., Yokkaichi (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/708,556

(22) Filed: Nov. 9, 2000

(30) Foreign Application Priority Data

Nov. 10, 1999 (JP) ..... 11-319749
May 24, 2000 (JP) ..... 2000-153350

(51) Int. Cl.[7] ..... H01R 13/52
(52) U.S. Cl. ..... 439/275; 439/587; 439/589
(58) Field of Search ..... 439/275, 274, 439/587, 589, 271, 272

(56) References Cited

U.S. PATENT DOCUMENTS 5,197,898 A 3/1993 Nagamine ..... 439/271
5,306,195 A 4/1994 Hayashi ..... 439/587
5,351,973 A 10/1994 Taniuchi et al. ..... 277/209
5,437,563 A 8/1995 Kihira et al. ..... 439/607
6,036,541 A * 3/2000 Koumatsu ..... 439/587
6,126,468 A 10/2000 Matsushita et al. ..... 439/271
6,203,348 B1 * 3/2001 Fukuda ..... 439/275

FOREIGN PATENT DOCUMENTS

FR 1202435 1/1960
JP 5-326066 12/1993

* cited by examiner

*Primary Examiner*—P. Austin Bradley
*Assistant Examiner*—Alexander Gilman
(74) *Attorney, Agent, or Firm*—Greenblum & Bernstein, P.L.C.

(57) ABSTRACT

Cavities capable of housing terminal fittings connected with the ends of electric wires W are provided inside of a housing. A rear assembly is assembled at the rear of the housing. The rear assembly includes a cover formed of a quality of material having no elasticity and a waterproof member formed of a quality of material having elasticity. The waterproof member further includes a wire seal part that surrounds and waterproofs electric wires, and a housing seal part that seals between the two housings. A clearance is provided about a periphery between the outer peripheral face of the wire seal part and the housing seal part. Even if the material of the wire seal part is deformed during the insertion operation of the electric wires, the insertion operation of the electric wires can be smoothly carried out to the last wire because the clearance absorbs the deformation of the entire wire seal part.

23 Claims, 16 Drawing Sheets

WATERPROOF CONNECTOR

BACKGROUND OF THE INVENTION

1. Field of the Invention

The present invention relates to a waterproof connector, and more particularly, to a waterproof connector is provided which does not incur problems in the mounting operation of terminal fittings.

2. Description of Background Information

A waterproof connector 100 disclosed in Japanese Patent Publication (Kokai) Hei No. 5-326066 is shown in FIG. 11 and FIG. 12. In the waterproof connector 100, a housing 103 is provided with cavities 102 capable of storing terminal fittings 101, and a waterproof member 104 made of an elastic material is mounted at the back of the housing 103. The waterproof member 104 is formed in a rectangular parallelepiped shape, and its outer peripheral rim 105 is designed to be fitted in the back of the housing 103.

Further, electric wire insertion holes 106 permitting insertion of electric wires W are provided in the waterproof member 104, corresponding to the positions of the cavities 102. Portions formed smaller than the outer diameters of the electric wires W are provided in the inner diameters of the electric wire insertion holes 106, and a watertight structure is made by elastically contacting the smaller portions with the outer peripheral surface of the electric wires W.

A worker carries out the work of mounting the terminal fittings 101 in the housing 103 by orderly pushing the terminal fittings 101 where one end of the electric wires W is inserted into the electric wire insertion holes 106.

At the beginning of the mounting work of the terminal fittings 101, the electric wire insertion holes 106 have a uniform size inner diameter, and the work of inserting the terminal fittings 101 is carried out without problems.

However, the outer peripheral surface of the electric wires W push the inner walls of the electric wire insertion holes 106 outwardly as the mounting work proceeds. In addition, the outer peripheral rim 105 of the waterproof member 104 is adhered to the side wall 103A of the housing 103 and outward elastic deformation is prevented. Therefore, the remaining electric wire insertion holes 106 are deformed and narrowed by distortion. Accordingly, there has been a problem that the insertion operation of the remaining terminal fittings 101 becomes difficult to be complete.

The present invention was developed with the above-mentioned circumstances in mind, and an object is to provide a waterproof connector which does not incur problems in the mounting operation of the terminal fittings.

SUMMARY OF THE INVENTION

In order to solve the above-mentioned problem, according to one aspect of the present invention, a waterproof connector is provided that includes a first housing having a plurality of cavities capable of housing each of a plurality of terminal fittings which are connected with one end of electric wires. A waterproof member is assembled to the rear of the first housing, and is provided with a housing seal part for sealing a fitting part with a mating side housing, and the mating side housing is joined to the first housing. A wire seal part provides a seal for the respective electric wires, and a plurality of electric wire insertion holes are provided in the wire seal part which permit the respective electric wires to be inserted into the housing. The wire seal part also surrounds the electric wires to provide a watertight fit where the wires penetrate the wire seal part, and a clearance is provided about the periphery between the outer peripheral face of wire seal part and the housing seal part.

In another aspect of the present invention, the wire seal part and the housing seal part are formed as separate bodies.

In a further aspect of the present invention, the wire sealing part and the housing sealing part are formed of members having material characteristics different from each other, and the hardness of the wire sealing part is lower than that of the housing sealing part, and the two sealing parts are separately formed.

According to a further aspect of the present invention, the waterproof connector may include a cover having a recess, the cover being capable of hooking on the first housing and capable of receiving the wire seal part, and the cover being mountable from the rear side of the first housing. The wire seal part may include a large diameter part having a plurality of large diameter holes at the rear side of the wire seal part, and a small diameter part having a plurality of holes positioned more toward the front side than the large diameter part. The holes of the small diameter part having smaller hole diameters than that of the large hole diameter, and the holes of the small diameter part being smaller than the outer diameter of the electric wires provided in the insertion holes. The clearance is arranged around the small diameter part, and on the other hand, the peripheral surface of the large diameter part of the wire seal part is received inside of the recess.

When the terminal fittings connected to the electric wires are inserted in the electric wire insertion holes, they forcibly expand the electric wire insertion holes by pushing, and the material around the electric wire insertion holes is pushed outwardly. The influence expands and propagates to the surrounding electric wire insertion holes. Accordingly, when an escape area for the material is not provided around the wire seal parts, the electric wire insertion holes where no electric wires are inserted are narrowed by the material which is gradually pushed outwardly. However, according to an aspect of the present invention, since the clearance is provided around the periphery of the wire seal part, the deformation of the entire wire seal part can escape to the clearance. Thus, the deformation tending to narrow the electric wire insertion holes where no electric wires are inserted can be avoided.

Furthermore, since the wire seal part and the housing seal part are formed by separate bodies, according to another aspect of the present invention, the wire seal part and the housing seal part can be formed of different materials. For example, the wire seal part is preferably a softer material permitting the electric wire insertion work. On the other hand, as the housing seal part takes only the seal between the housings into consideration, a comparatively harder material is often desired. Accordingly, a waterproof member having a good usability can be made by separately forming the wire seal part and the housing seal part, and by forming them from materials corresponding to their respective properties.

Additionally, in another aspect of the present invention, when the electric wires are inserted in the electric wire insertion holes, the location where the small diameter part is provided in the wire seal part is likely to be elastically deformed outwardly. Therefore, a clearance is provided around the location where the small diameter part is provided, and contact of the housing seal part with the wire seal part in the area of the clearance is avoided. Further, as the surrounding portion of the large diameter part is received inside the recess, the positional deviation of the wire seal part is regulated.

According to a further aspect of the invention, a waterproof connector is provided that includes a housing having a plurality of cavities each capable of receiving a respective one of a plurality of terminal fittings connected with one end of electric wires and a waterproof member mountable on a rear end of the housing. The waterproof member includes a housing seal part that forms a seal with a fitting part of a corresponding mating side housing, and a wire seal part that forms a seal with the respective electric wires. The wire seal part includes a plurality of electric wire insertion holes extending therethrough in alignment with the cavities, the wire insertion holes permitting respective electric wires to pass therethrough and surrounding the electric wires to form a watertight connection with the wires. Additionally, a clearance is provided in at least a portion of a peripheral area between an outer peripheral face of the wire seal part and the housing seal part, wherein the clearance permits outward deformation of the wire seal part to maintain easy insertability of the terminal fittings and wires until insertion of all wires is complete.

In another aspect of the present invention, the waterproof member may further include a cover having a recess, the cover being mountable on the rear side of the housing with the recess receiving the wire seal part, and wherein the electric wire insertion holes each include a large diameter part in a rear portion of the wire seal part, and a small diameter part in a forward portion of the wire seal part. The clearance is provided around the forward portion of the wire seal part, and the rear portion of the wire seal part is snugly received within the recess in the cover.

In other aspects of the present invention the rear portion of the wire sealing part of the waterproof connector may be removably received within the recess, and the housing sealing part may be fixedly attached to the cover. Additionally, the wire sealing part and the housing sealing part may be formed of members having material characteristics different from each other, the wire sealing part may have a hardness that is lower than that of housing sealing part, and the wire seal part and the housing seal part may be formed as separate members. Moreover, the housing sealing part may be attached to the cover by at least one of unitary molding and adhesive.

DETAILED DESCRIPTION OF THE PREFERRED EMBODIMENTS

Figure 1:
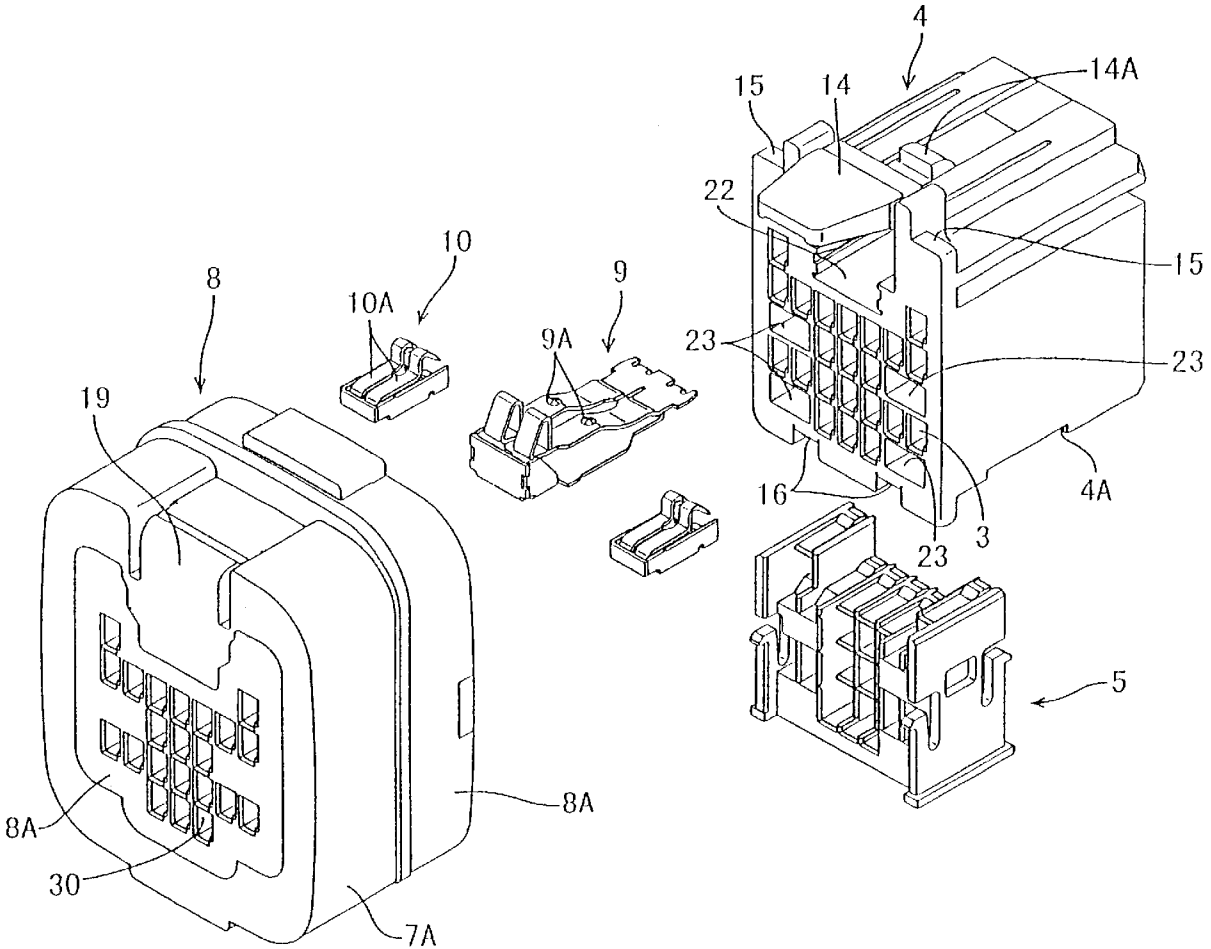
FIG. 1 is an exploded perspective view of the waterproof connector according to a first embodiment of the present invention.
Figure 2:
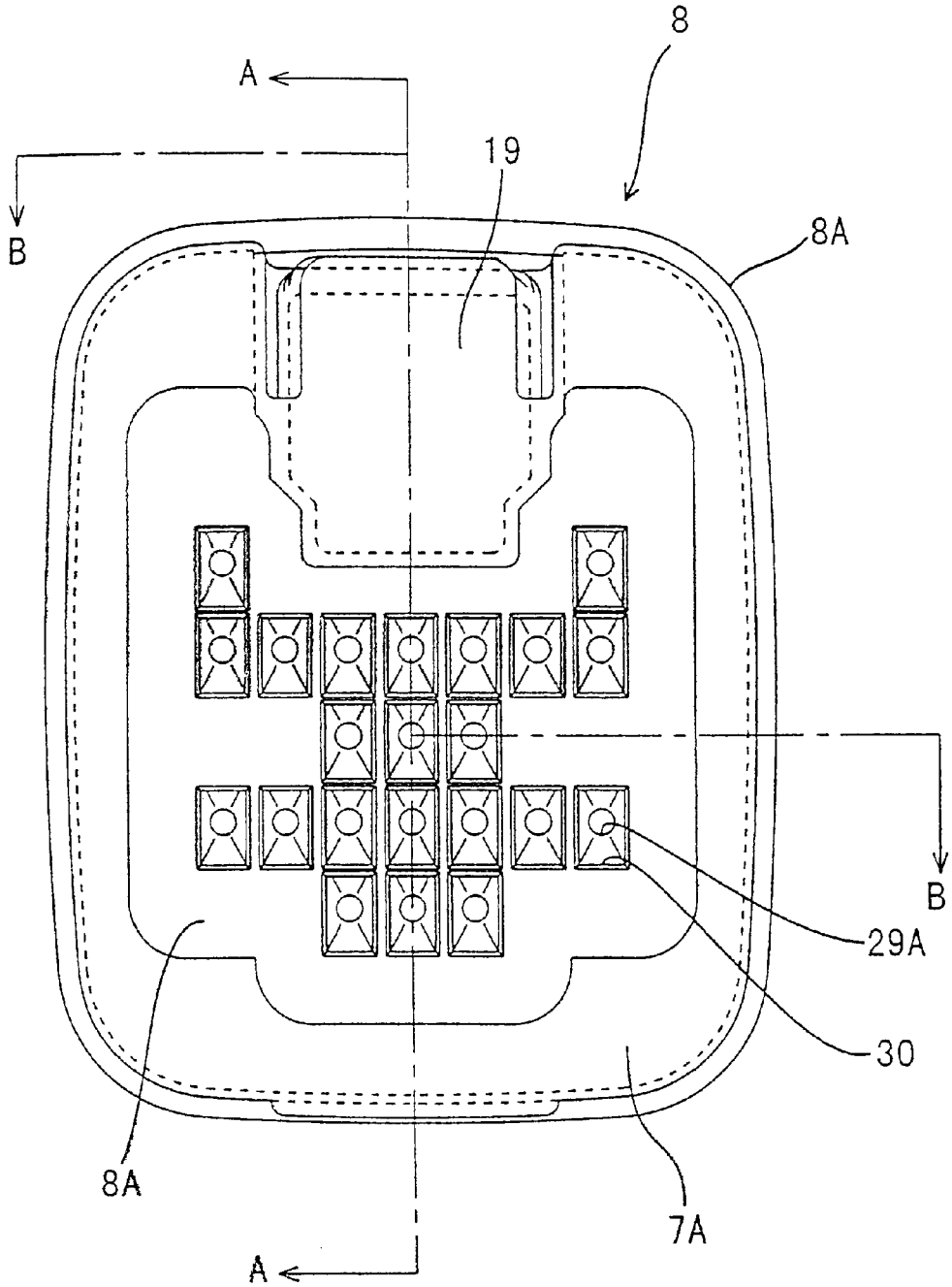
FIG. 2 is a rear view of a rear assembly of the connector of FIG. 1.

One embodiment of the present invention is illustrated in detail with reference to FIG. 1 through FIG. 10 of the drawings. An exploded perspective view of the waterproof connector 1 of an embodiment of the present invention is shown in FIG. 1. Further, in the description below, the side where the waterproof connector 1 and the mating side housing 6 are mutually fitted is defined as the front side, and the up and down directions are represented by the positional relationship shown in FIG. 1.

Figure 9:
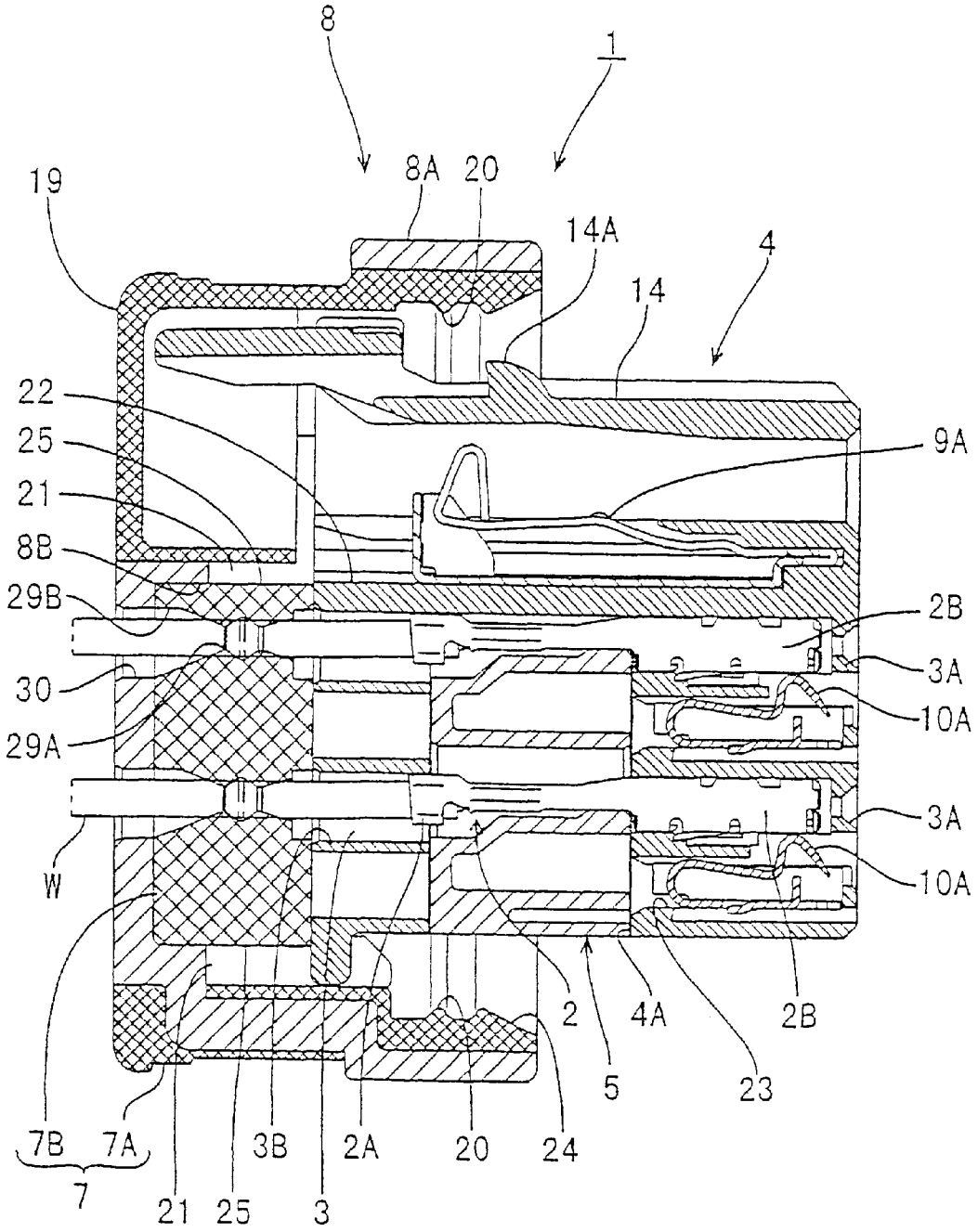
FIG. 9 is a sectional side view of the waterproof connector of the present invention.
Figure 10:
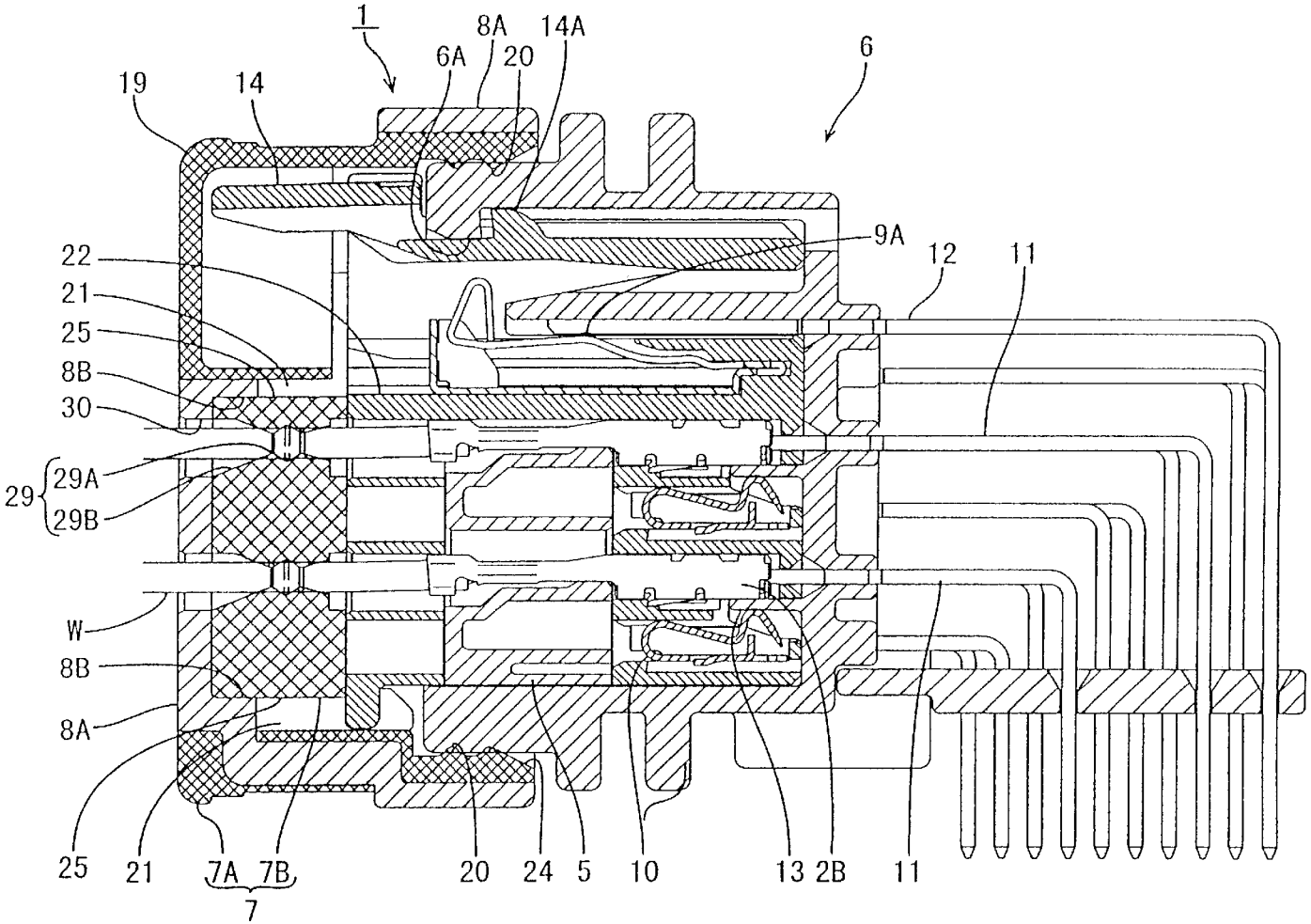
FIG. 10 is a sectional side view showing the waterproof connector of the present invention fitted with a mating side housing.
Figure 11:
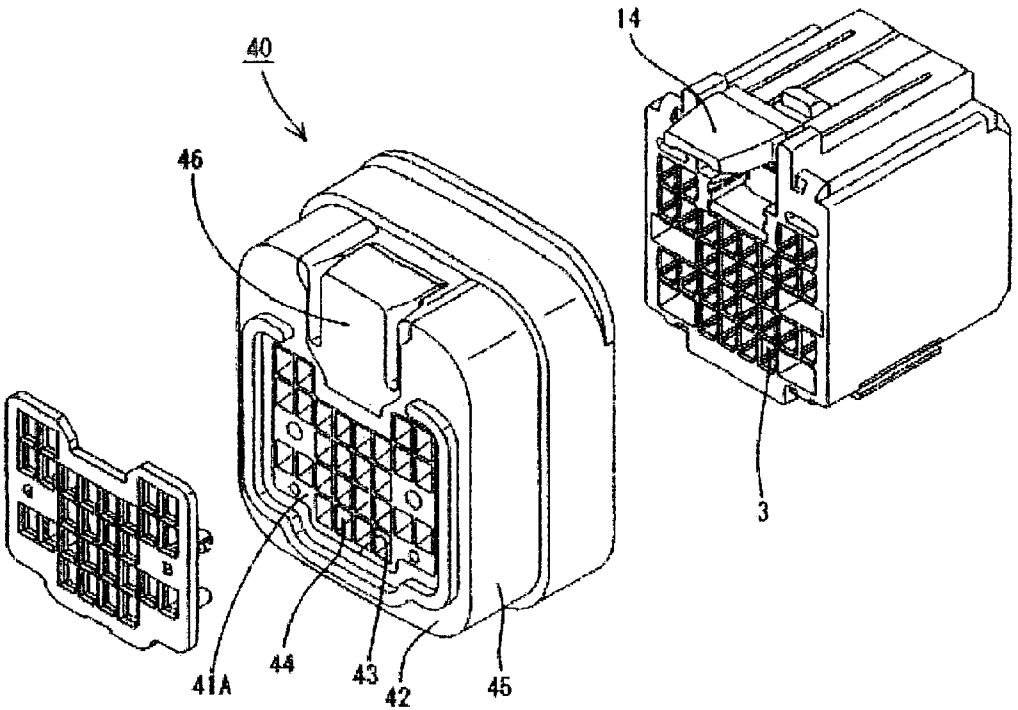
FIG. 11 is an exploded perspective view of a waterproof connector according to a second embodiment of the present invention.

In the waterproof connector 1, a housing 4 is provided with cavities 3 capable of receiving female terminal fittings 2 (note FIG. 9 and FIG. 10). A retainer 5 is assembled from the lower side of the housing 4, and a rear assembly 8 is assembled from the back of the housing 4. The housing 4 is formed in a rectangular parallelepiped shape from, for example, a synthetic resin, and two types of short circuit terminals 9, 10 are provided for mounting in the inner part of the housing in addition to the terminal fittings 2.

The construction of the terminal fittings 2 is illustrated with reference to FIG. 9. The terminal fittings 2 are formed by bending an electro-conductive plate, and barrel portions 2A capable of connecting to the electric wires W are provided at the rear end. Further, square tubular shaped connecting parts 2B capable of connecting to male tabs 11, to be described later, are provided in the front end of the terminal fittings 2.

The terminal fittings 2 can be mounted inside the cavities 3 of the housing 4, and the front of the housing is provided with a plurality of connection holes 3A where the mating side male tabs 11 are to be inserted. However, the back of the housing 4 is mainly open to provide the terminal mounting holes 3B capable of receiving the inserted terminal fittings 2. The terminal fittings 2 are hooked to be retained inside of the cavities 3 by the retainer 5 assembled from the retainer mounting opening 4A which opens to the lower side of the housing 4.

Further, two hooking positions of the retainer 5 are provided: a temporary hooking position where the retainer 5 is partially inserted into the housing 4, and a complete hooking position where the retainer 5 is completely inserted into the housing 4. The terminal fittings 2 can be inserted and removed in the cavities 3 when the retainer 5 is positioned in the temporary hooking position. On the other hand, the terminal fittings 2 are hooked in the cavities 3 when the retainer 5 is positioned in the complete hooking position.

Additionally, a lock arm 14 that is elastically deformable in the up and down directions is provided at the central upper side of the housing 4. The lock arm 14 is formed as a cantilever, with the front part of the lock arm 14 connected to the upper side of the housing 4. Further, a hooking protrusion 14A extends upwardly at the center of the lock arm 14, and the housings 4, 6 are hooked together by hooking the hooking protrusion 14A on the hooking receiving portion 6A (shown only in FIG. 10).

Further, a short circuit assembly recess 22 is provided in the space below the lock arm 14 (notes FIGS. 9 and 10), wherein a large size short circuit terminal 9 may be assembled. Further, two pairs of left and right cavities 23 for short circuit terminals are provided at the central part and lower part of the housing 4, wherein small size short circuit terminals 10 may be assembled. The short circuit terminals 9, 10 are formed by respectively pressing an electroconductive plate and then bending to have the configurations shown in FIG. 1.

A pair of elastic contact pieces 9A capable of being elastically deformed in up and down directions are provided on the large size short circuit terminals 9. The contact pieces 9A are capable of elastically contacting a pair of short circuit elements 12 (refer to FIG. 10) which are provided in the inside of the mating side housing 6.

Further, a pair of left and right elastic contact pieces 10A capable of being elastically deformed in up and down directions are provided on small size short circuit terminals 10 (only a pair of short circuit terminals 10 are shown in FIG. 1 for convenience of illustration, but a maximum of four can be housed according to the first embodiment). Each of the respective elastic contact pieces 10A is capable of elastically contacting the connecting parts 2B of the terminal fittings 2 which are mounted in the upper side of cavities 23 for short circuit terminals. The elastic contact pieces 10A are placed in contact with the connecting parts 2B of the terminal fittings 2 before the waterproof connector 1 and the mating side housing 6 are fitted (refer to FIG. 9). When both of the housings are fitted together, the elastic contact pieces 10A and the connecting parts 2B are designed to be separated by the insulation pieces 13 provided in the mating side housing 6 (further refer to FIG. 10).

A pair of engaging edges 15 are provided at the left and right sides of the lock arm 14 on the upper part of the back of the housing 4. Hooking arms 17 (see FIGS. 3 and 5) of the rear assembly 8 to be described later are configured to be elastically hooked on the engaging edges 15. Further, a pair of left and right engaging recesses 16 are provided on the lower part of back of the housing 4. The hooking arms 18 of the rear assembly 8 are configured to be elastically hooked on the engaging recesses 16.

The rear assembly 8 is formed so as to be able to cover the back of the housing 4 as shown in FIG. 2 to FIG. 5. The rear assembly includes a cover 8A formed, for example, by molding from a resin having no elasticity and a waterproof member 7 formed, for example, by molding from a material having elasticity. The waterproof member 7 is further separately configured to include a housing seal part 7A sealing the fitting part of the mating side house 6 and the housing 4, and a wire seal part 7B carrying out the sealing of the electric wires W connected with the terminal fittings 2. The cover 8A and waterproof member 7 are integrally formed by two-color molding.

Further, in the present mode of operation, both of the housing seal part 7A and the wire seal part 7B are respectively formed of a different material. Namely, the wire seal part 7B is formed of a softer quality of material taking into account the assembly work of inserting the electric wires W therethrough. On the other hand, the housing seal part 7A is formed of a comparatively harder quality of material taking into account the seal between the housings 4, 6.

Figure 3:
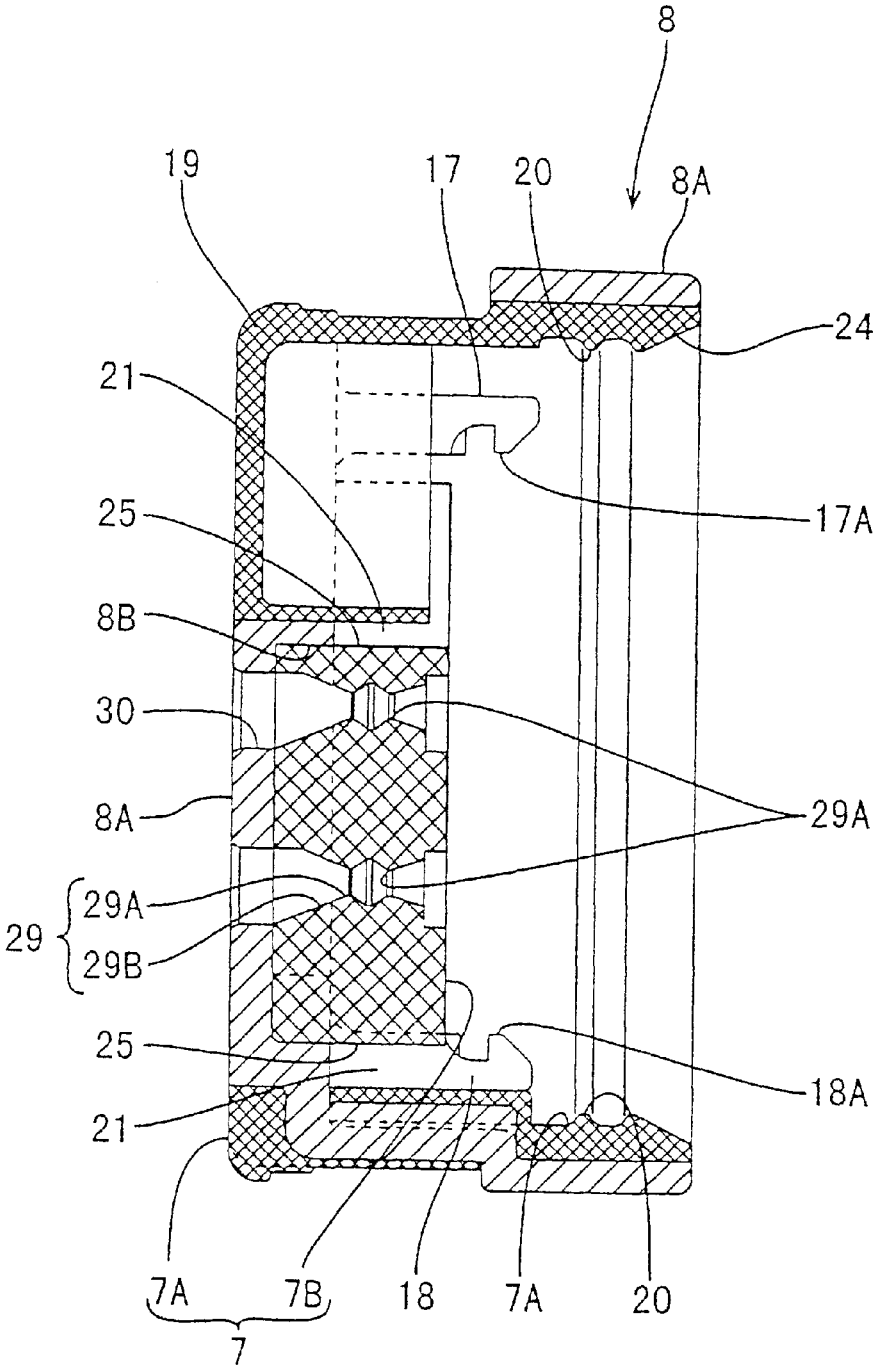
FIG. 3 is a sectional view taken along the line A—A in FIG. 2.

Further, as shown in FIGS. 1 and 3, portions of the cover 8A are exposed at the back end and at the frontal portion, looking at the rear assembly 8 from the exterior, and on the other hand, the housing seal part 7A is exposed from an intermediate portion to a back portion.

The cover 8A opens forwardly and is provided with one part of the housing seal part 7A in the inside, which includes an assembly opening 24. The lock arm 14 of the housing 4 can be positioned within the assembly opening 24, and the operation of pressing against the lock arm 14 is made possible by applying pressure to the lock arm 14 by way of the operational portion 19 of the seal 7A which protrudes outwardly from the housing 4. Further, a plurality of housing waterproof ribs 20 are provided in a wave shape (in cross-section) about the entire periphery of the inner rim of the assembly opening 24. The housing waterproof ribs 20 are slightly deformed elastically by being pushed on the outer face of the mating side housing 6 to provide the clearance between the housing 4, 6 with a watertight condition.

Electric wire insertion holes 29 are configured for inserting the electric wires W and are provided at a plurality of locations in the wire seal part 7B. The respective electric wire insertion holes 29 are formed by penetrating the front and rear of the wire seal part 7B, and are provided to coincide with the position of the cavities 3 of the housing 4. Further, as shown in FIG. 3, the inner walls of the electric wire insertion holes 29 are provided with large diameter parts 29B formed to extend forwardly with nearly same diameter from the rear opening of the wire seal part 7B, and narrow down to provided small diameter parts 29A having smaller diameters at a position forwardly of the large diameter parts 29B. The diameter of the large diameter parts 29B is configured to be the same as, or slightly larger than, the outer diameter of the electric wires W. On the other hand, the small diameter parts 29A are provided about the entire inner periphery of the electric wire insertion holes 29, and the diameter of the small diameter parts 29A is formed to be smaller than the outer diameter of the electric wires W. Thus, the electric wire insertion holes 29 form a watertight structure by pressing the small diameter parts 29A against the outer periphery of the electric wires W.

The wire seal part 7B is housed in a recess 8B provided in the inner side (the side assembled to the housing 4) of the cover 8A. The recess 8B is provided only around the large diameter parts 29B of the electric wire insertion holes 29 from the position of central rear side of the wire seal part 7B to the back end part, and is not provided around the part where the small diameter parts 29A are provided from the center of the wire seal part 7B to the front side (note FIG. 3). Further, the inner periphery of the recess 8B is configured to be the same as the outer periphery of the wire seal part 7B. Therefore, the rear side of the wire seal part 7B is fixed in position (namely, in a condition in which an elastic deformation in up and down and left and right directions is regulated), and on the other hand, elastic deformation is possible from the center of the wire seal part 7B to the front end.

Figure 5:
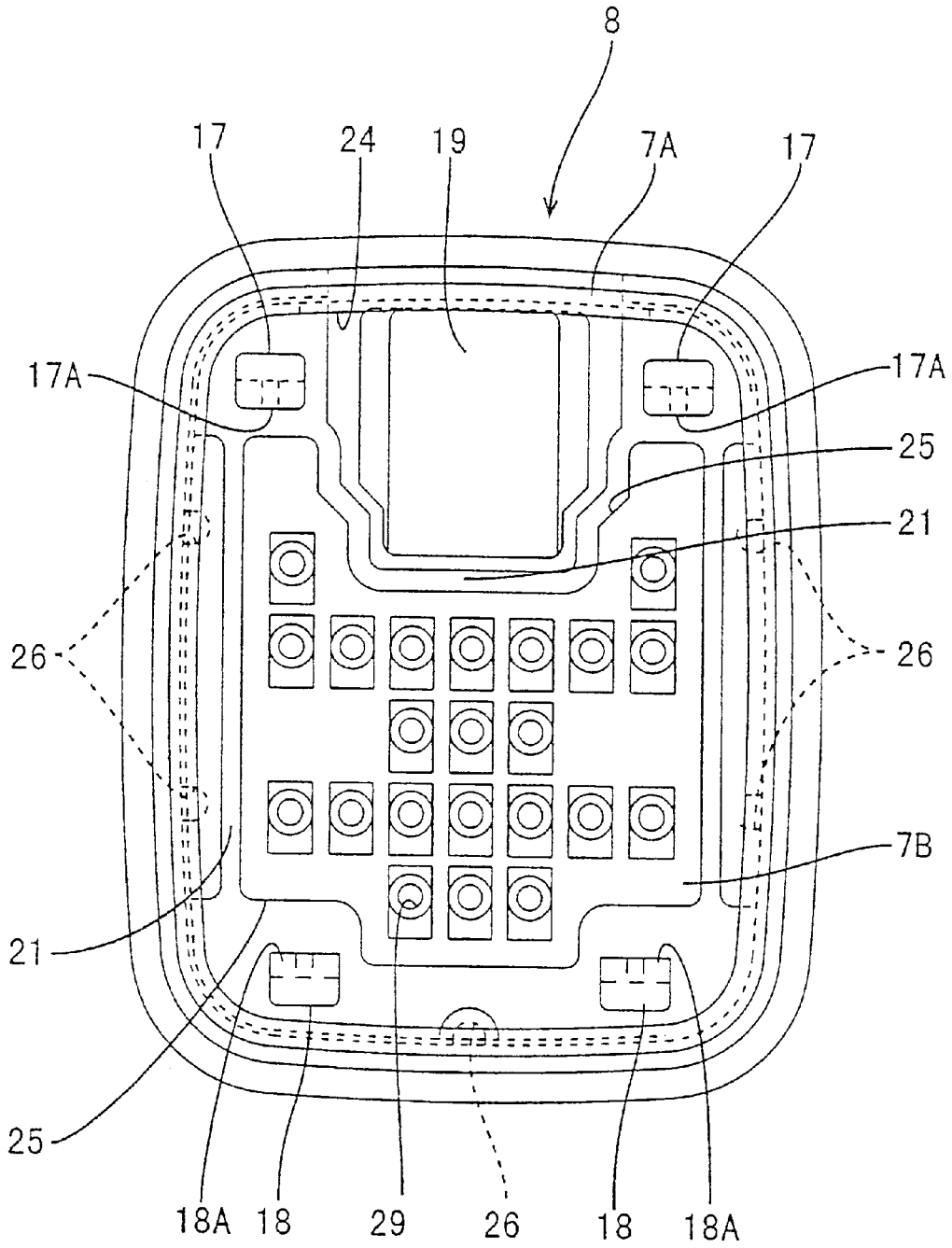
FIG. 5 is a front view of the rear assembly of the connector.
Figure 6:
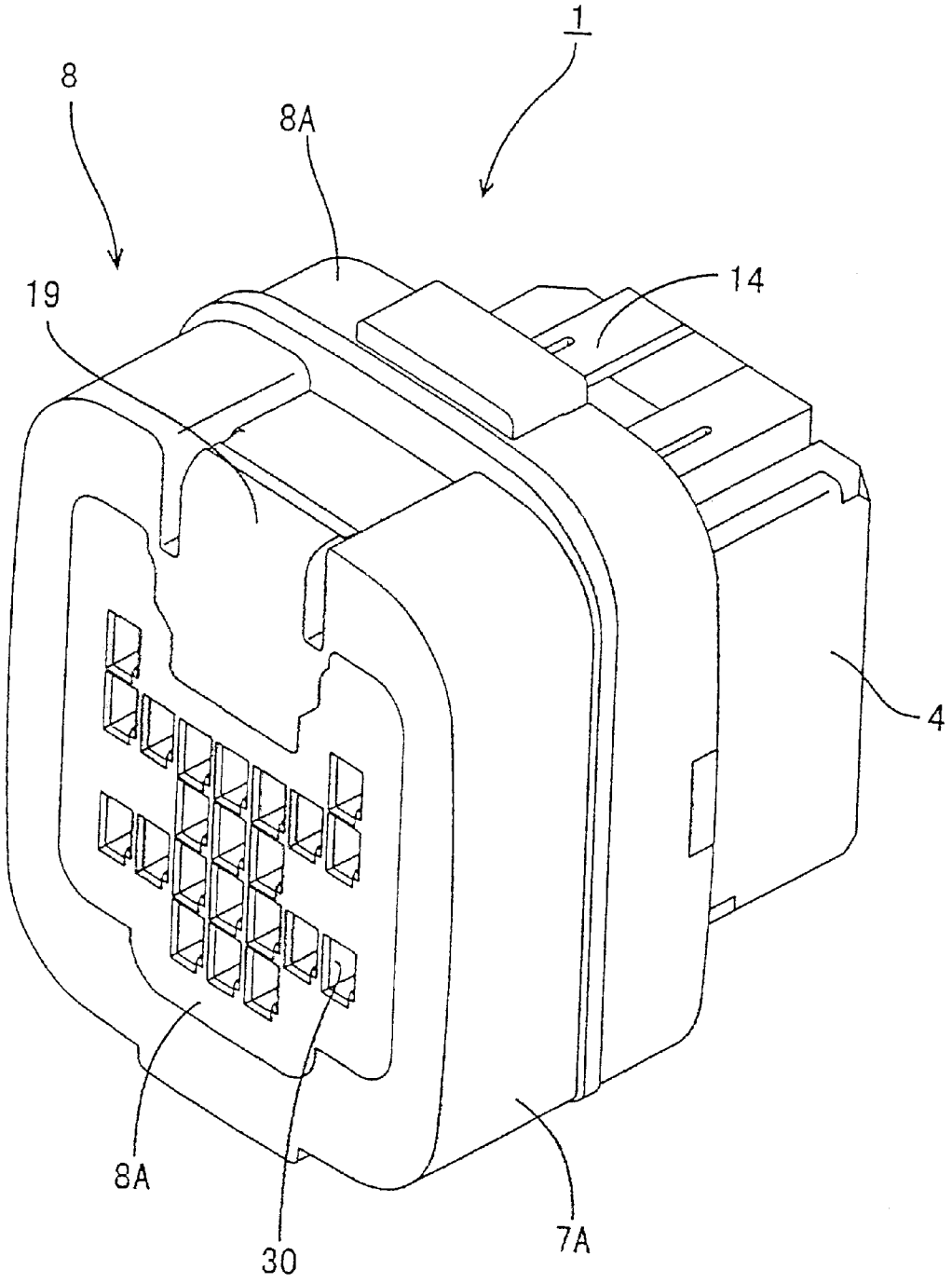
FIG. 6 is a perspective view of the waterproof connector according to the first embodiment of the present invention.
Figure 7:
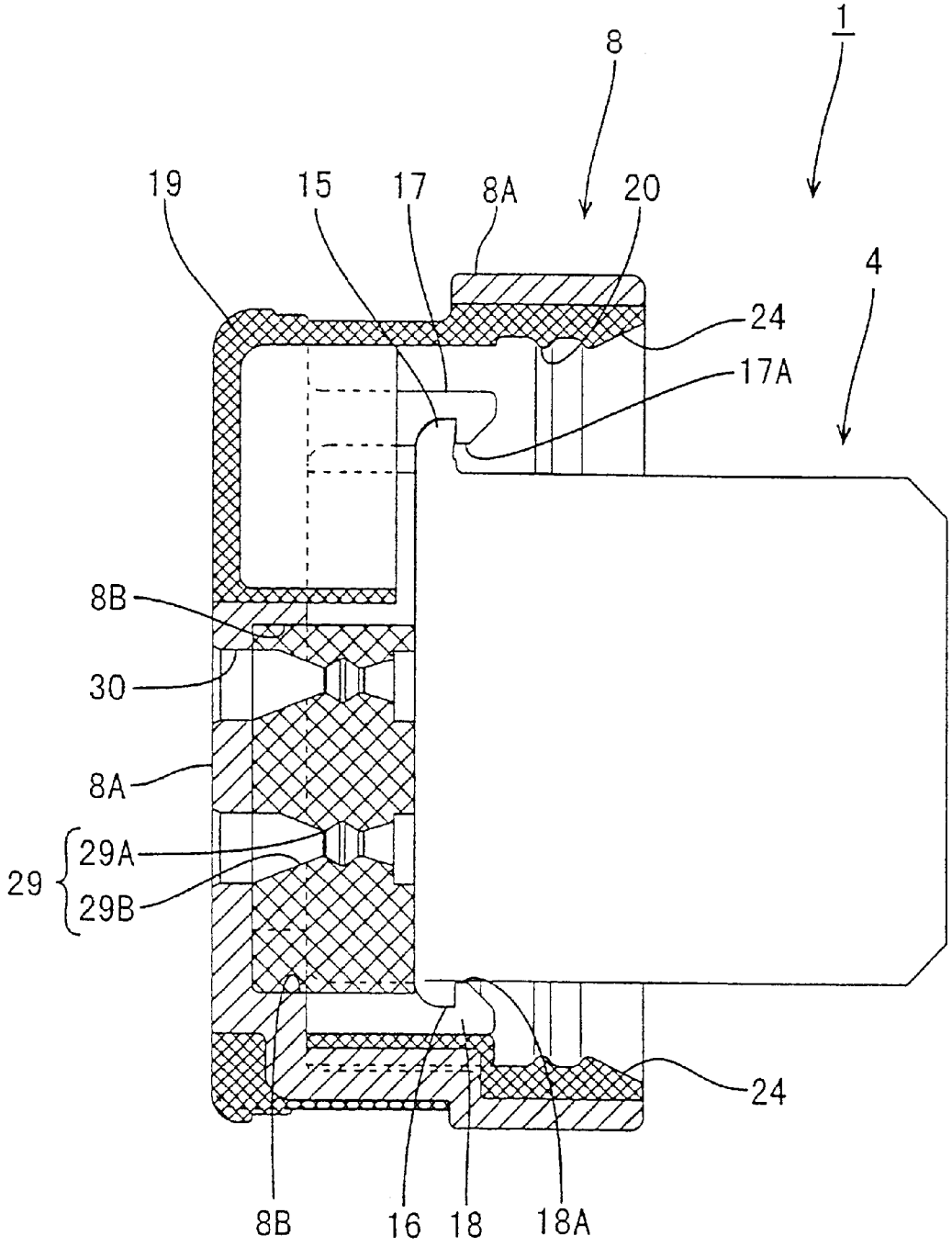
FIG. 7 is a sectional side view showing the hooking of a housing with the rear assembly, in the interior of the waterproof connector of the present invention.
Figure 8:
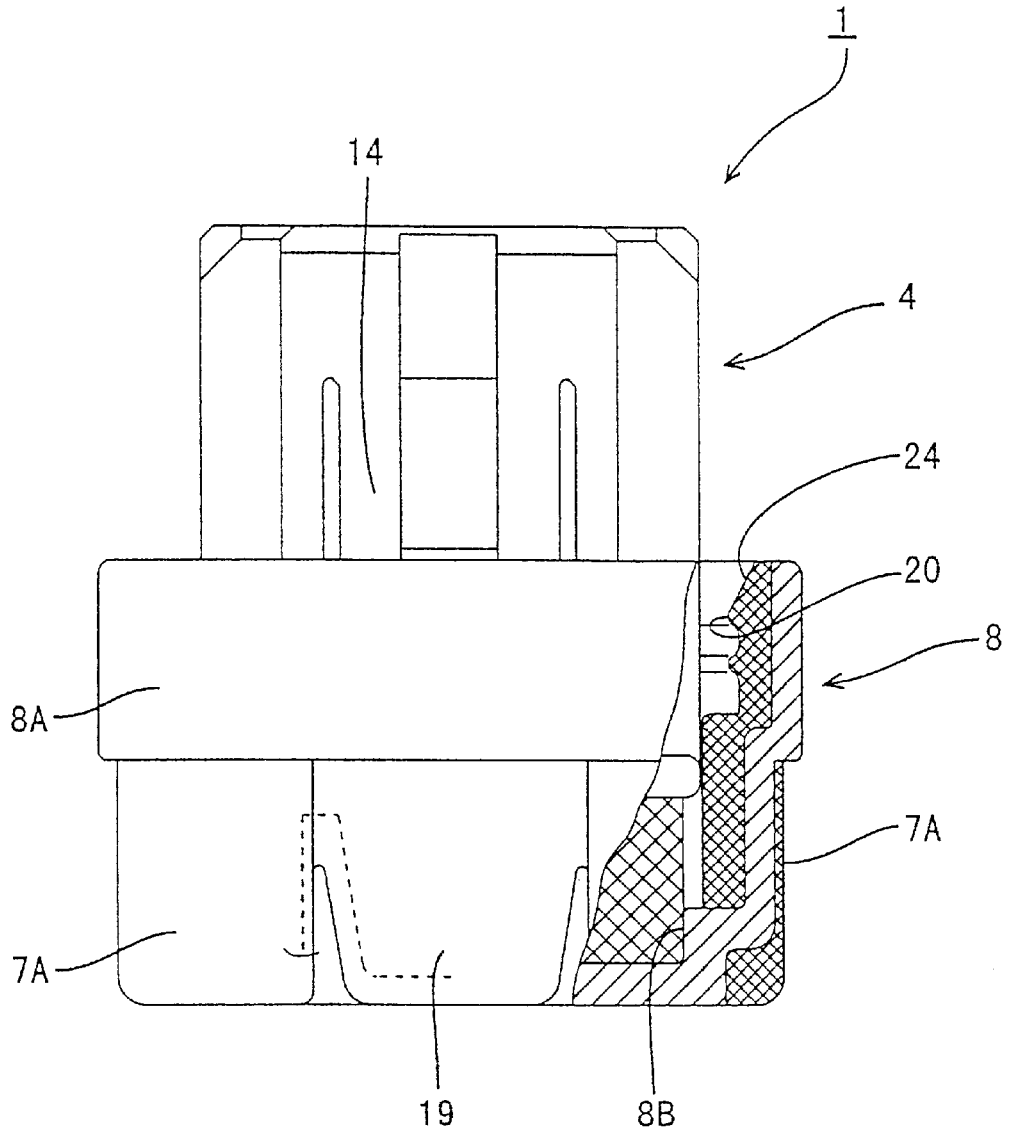
FIG. 8 is a partially broken away plan view of the waterproof connector of the present invention.

Further, electric wire insertion holes 30 aligned with the position of the electric wire insertion holes 29 of the wire seal part 7B are provided in the cover 8A of the rear end of the rear assembly 8. Thus, insertion of the electric wires W is possible by penetrating both of the holes 29, 30. Further, as shown in FIG. 5, in the inner side of the cover 8A, the pair of hooking arms 17 protrude forwardly at the left and right sides of the operational part 19. The hooking arms 17 are configured to be elastically deformable in up and down directions, and thus to hook on the hooking rims 15 of the housing 4. Further, the hooks 17A protrude downward at the front end of the hooking arms 17.

Additionally, the pair of left and right hooking arms 18 protrude forwardly at the lower ends, in the inside of the cover 8A. Hooks 18A protrude upwardly at the front end of the hooking arms 18, which makes it possible to hook on the engaging recesses 16 of the housing 4. Further, the hooking arms 18 are configured to be elastically deformable in the up and down directions.

Furthermore, resin passing holes 26 are provided at both sides of the left and right rim parts and the lower end part, in the inside of the cover 8A. The resin passing holes 26 penetrate from the front to the rear of the cover 8A, and are configured so that a molten resin can easily flow to the front and rear of the cover 8A when the housing seal part 7A is formed on the surface of the cover 8A. Further, after the rear assembly 8 is formed, a part of the material of the housing seal part 7A is formed in the resin passing holes 26. Thus, separation of the cover 8A and the housing seal part 7A can be prevented.

Figure 4:
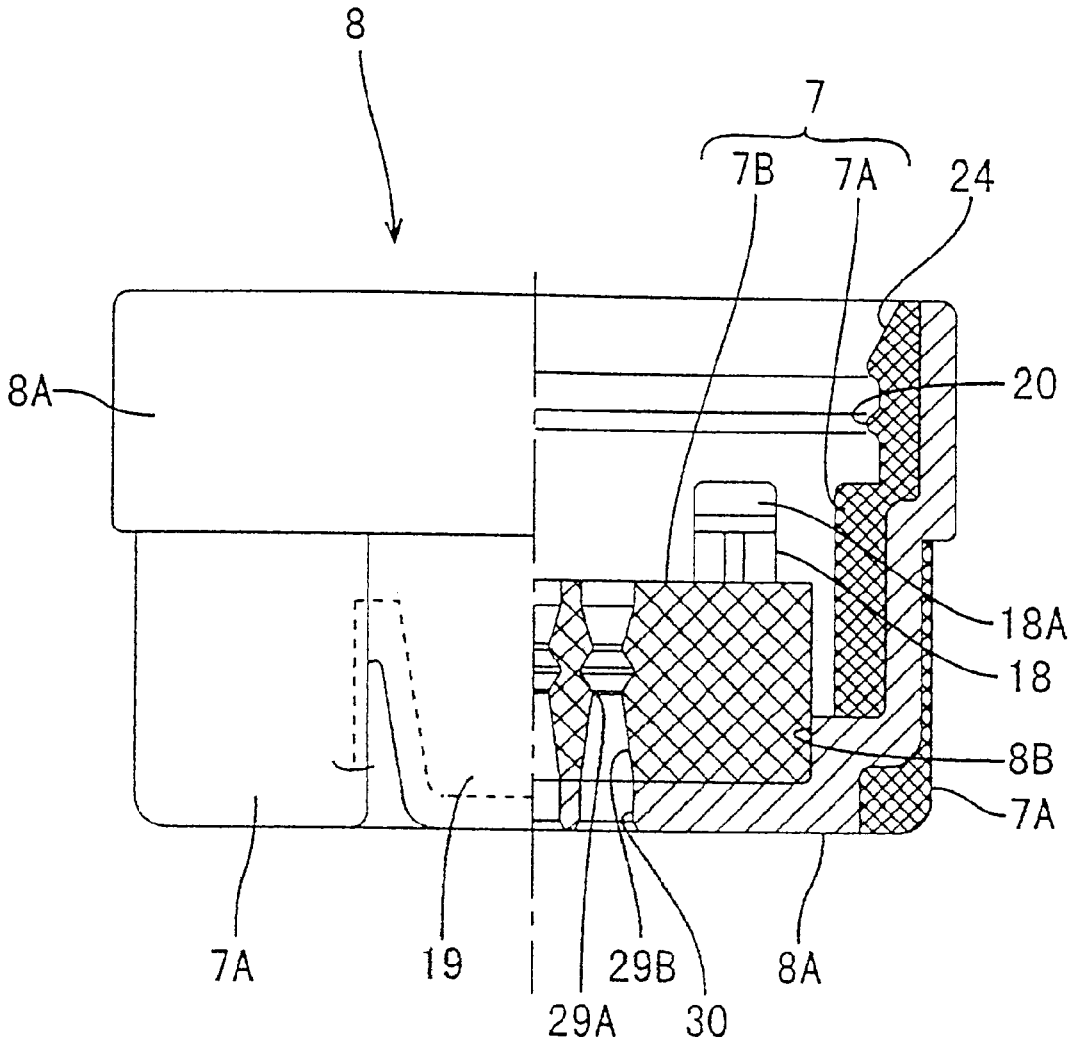
FIG. 4 is a sectional view taken along the line B—B in FIG. 2.

Also, as shown in FIG. 3 to FIG. 5, an appropriate clearance 21 is provided about the peripheral area between the outer peripheral face 25 of the wire seal part 7B and the housing seal part 7A. The position of the clearance 21 corresponds to the surrounding of the part where the small diameter parts 29A are provided in the electric wire insertion holes 29 of the wire seal part 7B. This corresponds to the outward elastic deformation which is caused by pressing of the small diameter parts 29A when the electric wires W pass through the electric wire insertion holes 29. This results in a situation where narrowing of the electric wire insertion holes 29 where the electric wires W are not inserted is avoided when the material of the housing seal part 7A is pressed outwardly by the electric wires W in accordance with the proceeding of the insertion work of the electric wires W.

The construction of the mating side housing 6 is illustrated referring to FIG. 10. The mating side housing 6 is formed unitarily and in one piece in generally a hood shape by, for example, a synthetic resin. A plurality of male tabs 11 formed of an electro-conductive material and a pair of short circuit pieces 12 are housed within the mating side housing 6. Further, insulation pieces 13 which insulate contact of the terminal fittings 2 from the elastic contact pieces 10A are provided on the inside of the mating side housing 6. Further, a hooking receiving part 6A is provided to protrude downwardly on the inside of the upper face, which is hooked by the lock arm 14 so that both of the housings 4, 6 are secured together by hooking.

The operation and effect of the construction of the embodiment of the present invention as described above are illustrated with reference to FIG. 6 to FIG. 10.

First, the large size short circuit terminals 9 are assembled in the short circuit assembly recess 22 of the housing 4, the requisite numbers of the short circuit terminals 10 are mounted in the cavities 23 for short circuit terminals, and the housing 4 and the retainer 5 are assembled in a temporary hooking state.

Next, the back side of the housing 4 is pushed into the assembly opening 24 of the rear assembly 8. At this time, the pair of left and right hooking arms 17 of the upper side are hooked on the engaging edges 15, and on the other hand, the pair of left and right hooking arms 18 of the lower side are hooked on the engaging recesses 16 to unify the housing 4 and the rear assembly 8. At this time, the lock arm 14 is positioned inside of the operational part 19, and the lock arm 14 can be deformed to a bent position by pressing on the operational part 19 from the outside of the rear assembly 8.

After completing the assembly of the waterproof connector 1, the terminal fittings 2 with which one end of the electric wires W is connected are inserted through both of the holes 29, 30 from the back side of the waterproof connector 1, and are inserted into the fixed cavities 3. The insertion work of the electric wires W is designed to be smoothly carried out because the wire seal part 7B is formed from a soft elastic material.

Further, since the outer periphery of the electric wires W forcibly pushes to expand the electric wire insertion holes 29 as the insertion work of the electric wires W proceeds, the material around the electric wire insertion holes 29 is pushed outwardly. The influence expands and propagates to the surrounding electric wire insertion holes 29. However, according to the present embodiment, the clearance 21 provided to surround the wire seal part 7B absorbs the outwardly pushed material.

Accordingly, even though the insertion work of the electric wires W proceeds, the diameters of the electric wire insertion holes 29 not yet inserted do not become too greatly narrowed, and the insertion work of the electric wires W can be smoothly carried out to the last wire.

After all of the terminal fittings 2 are mounted in the cavities 3, the retainer 5 is pushed in to the proper hooking position to cause the terminal fittings 2 to be in a hooking condition (refer to FIG. 9).

Finally, the housing 4 of the waterproof connector 1 is fitted with the mating side housing 6. When both of the housings 4, 6 are fitted to a fixed position, both of the housings 4, 6 are hooked together by elastically hooking the hooking protrusion 14A of the lock arm 14 on the hooking receiving portion 6A. At this time, the housing waterproof part 20 of the waterproof member 7 is sandwiched between the housings 4, 6 by a fixed contact pressure so as to be slightly deformed elastically. Therefore, both of the housings 4, 6 are connected together in a watertight condition. Further, the terminal fittings 2 are connected with the male tabs 11 inside both of the housings 4, 6 and a pair of short circuit pieces 12 come in contact with the elastic contact pieces 9A of the short circuit terminals 9 (refer to FIG. 10).

Thus, according to the present mode of operation, the material around the electric wire insertion holes 29 is pushed outwardly as the operation of inserting the terminal fittings 2 connected with the electric wires W into the electric wire insertion holes 29 proceeds, and the influence of the inserted wires expands and propagates to the surrounding electric wire insertion holes 29.

Figure 12:
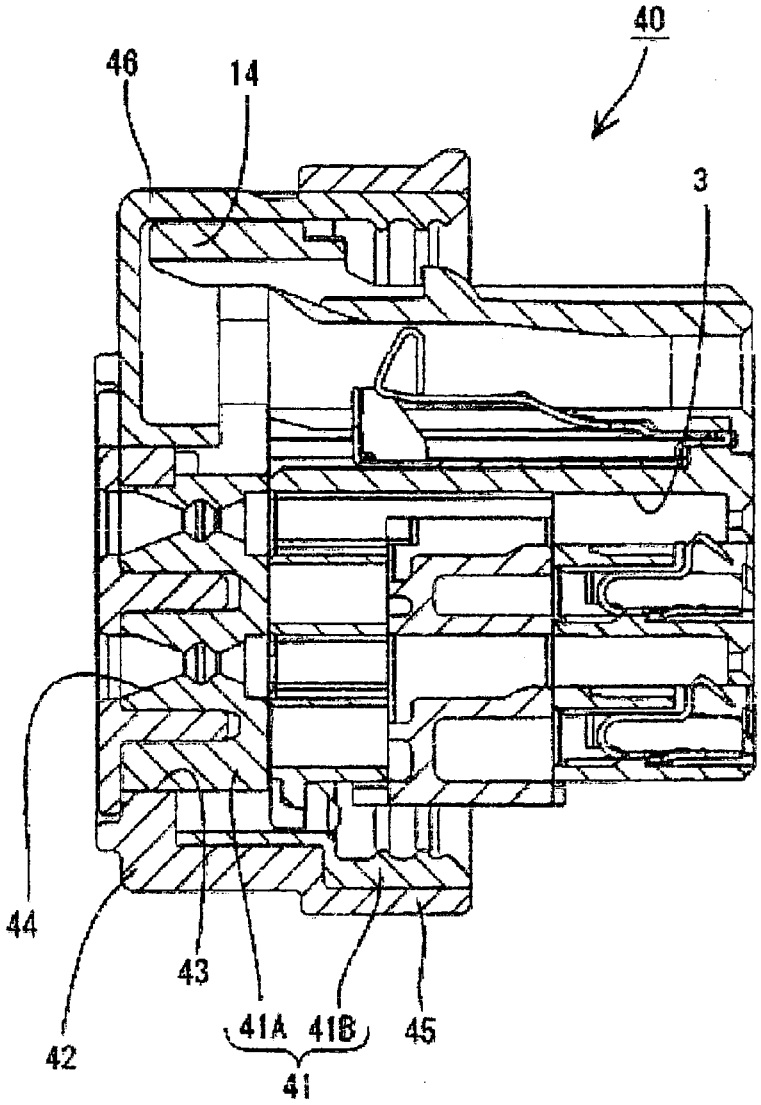
FIG. 12 is a section view of the connector of FIG. 11 in an assembled condition.
Figure 13:
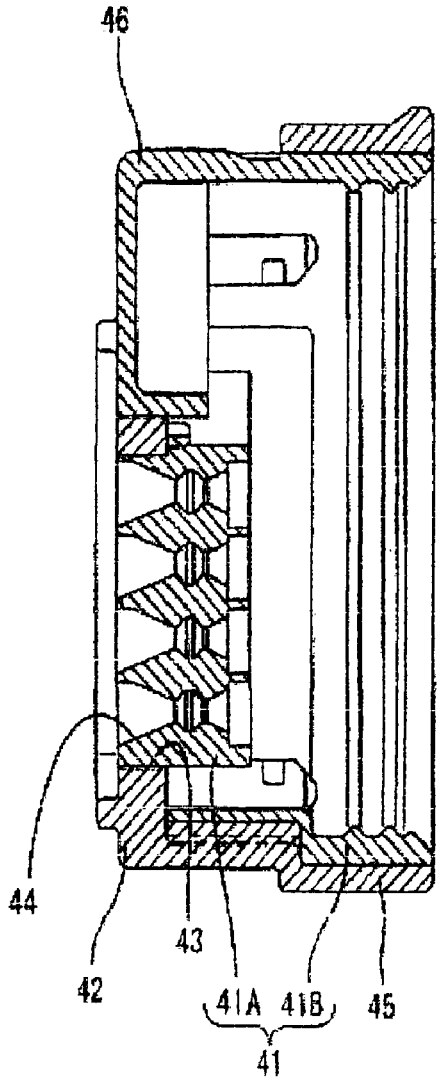
FIG. 13 is a sectional view of a rear cover of the connector of FIG. 11 assembled with a waterproof member.
Figure 14:
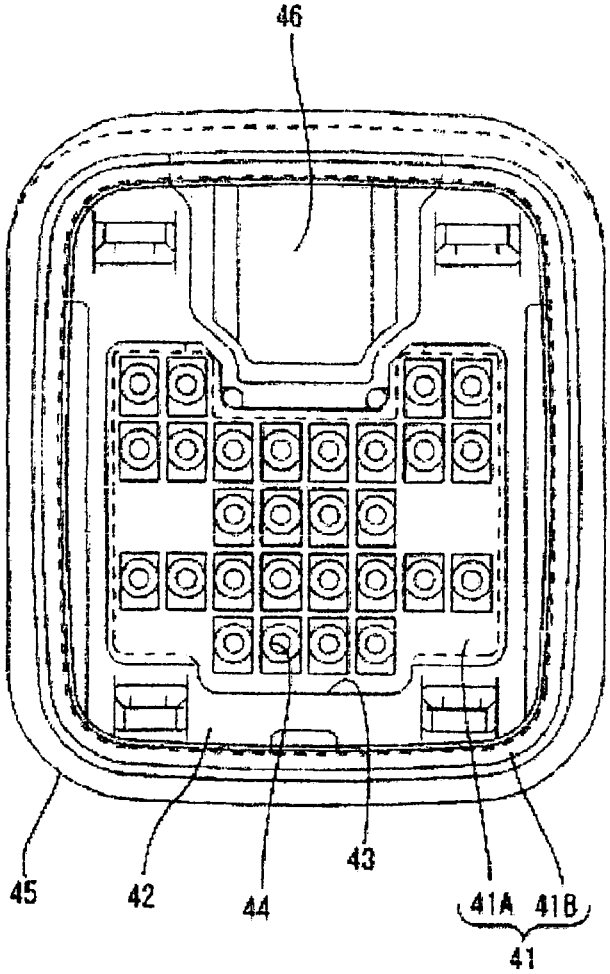
FIG. 14 is an elevation view of the condition of FIG. 13 in which the rear cover is assembled with the waterproof member.
Figure 15:
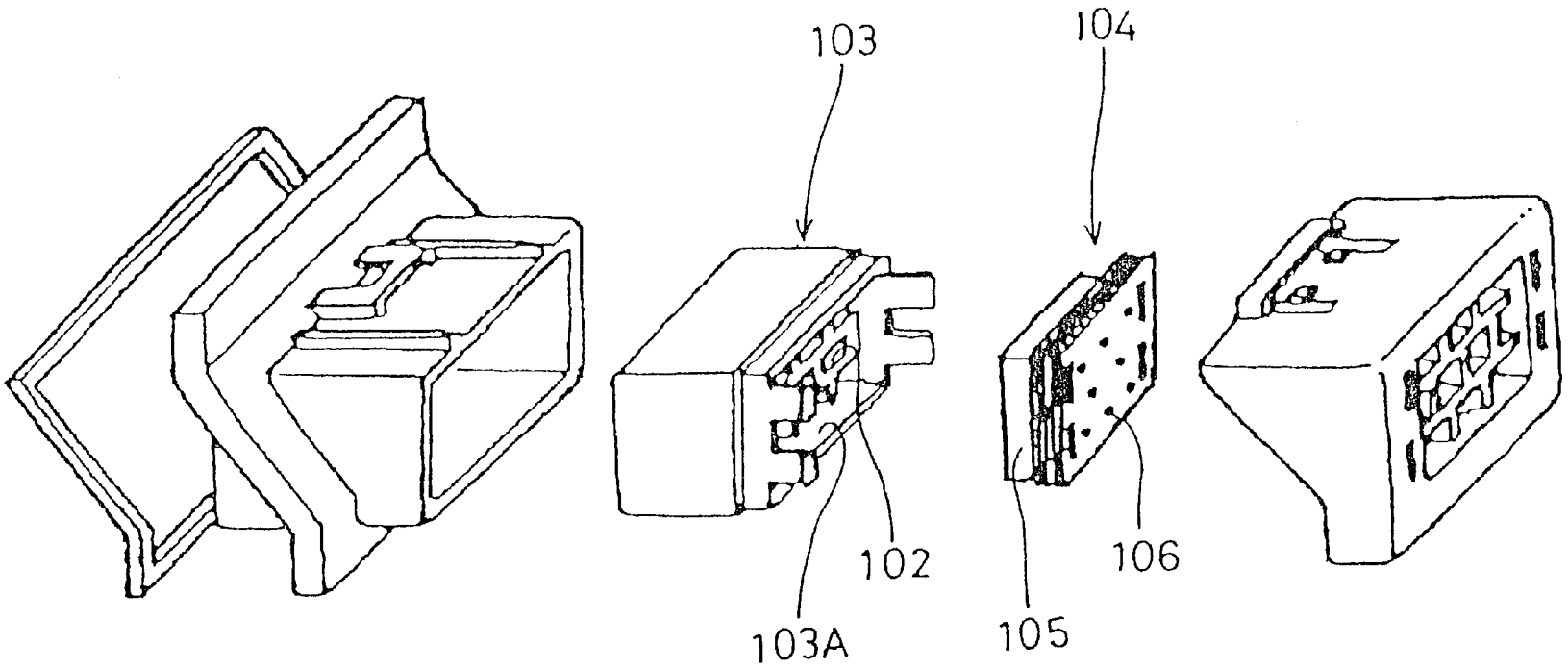
Fig. 15 (PRIOR ART)
FIG. 15 is an exploded perspective view of a conventional waterproof connector.
Figure 16:
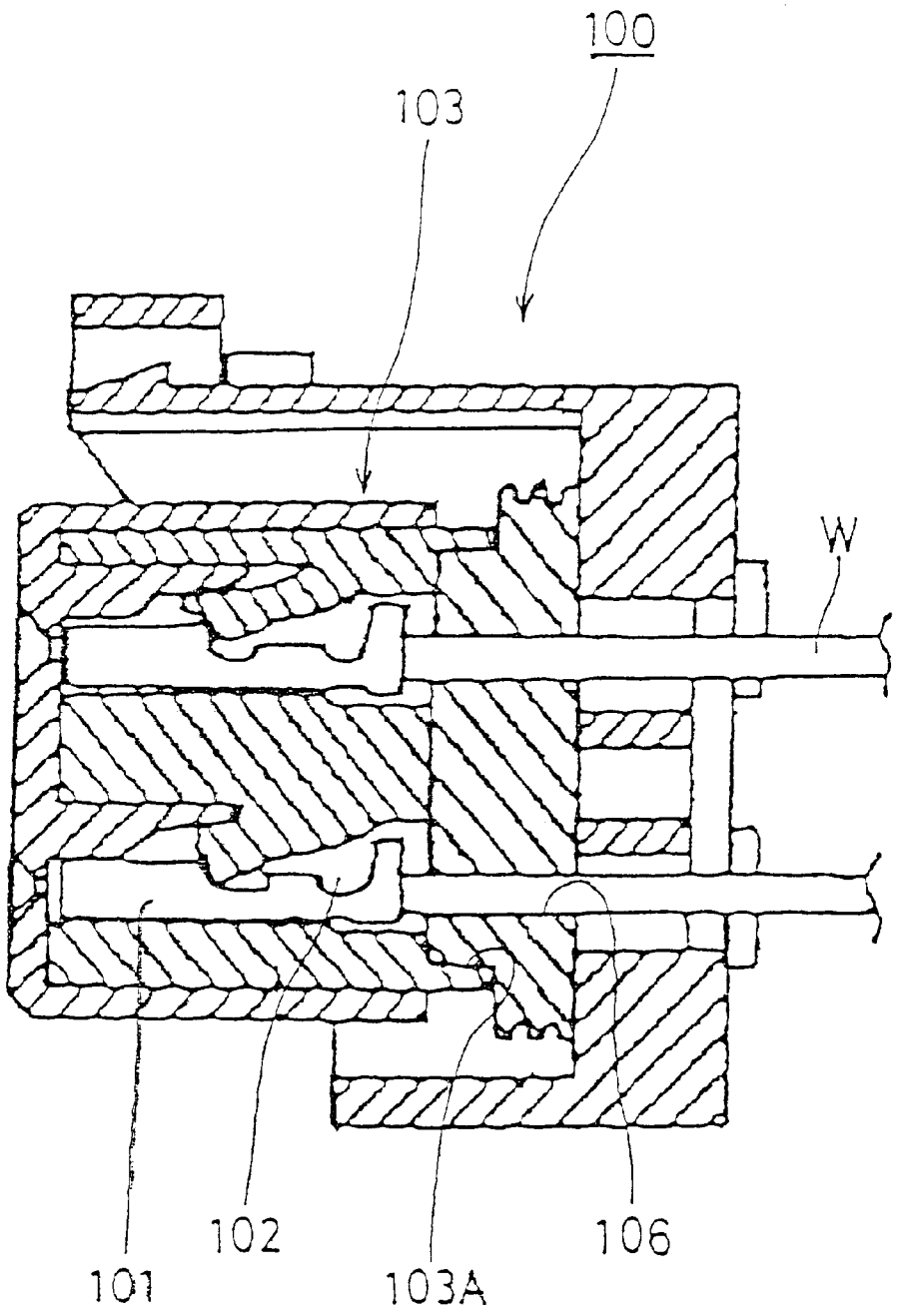
Fig. 16 (PRIOR ART)
FIG. 16 is a sectional side view of the conventional waterproof connector of FIG. 11.

Accordingly, when the escape area for the material around the electric wire insertion holes 106 (FIG. 12) is not provided, as in the conventional example, the electric wire insertion holes 106 where the electric wires W are not inserted are narrowed by the material gradually pushed outwardly, and the insertion operation of the electric wires W becomes more difficult to carry out. But in the present mode of operation, since the clearance 21 is located about the periphery of the wire seal part 7B, the deformation of the entire wire seal part 7B can escape into the clearance, and the deformation causing narrowing of the electric wire insertion holes 29 where no electric wires W are inserted can be avoided.

Further, when the electric wires W are inserted in the electric wire insertion holes 29, the portion where the small diameter parts 29A are provided in the wire seal part 7B is easily elastically deformed mostly to the outside. Therefore, contact of the housing seal part 7A with the wire seal part 7B is avoided by providing the clearance 21 around the portion where the small diameter parts 29A are provided. Further, since the surrounding of the part where the large diameter parts 29B are provided is housed in a condition in which it is positioned within the recess 8B, the positional deviation of the wire seal part 7B is regulated.

Further, the housing seal part 7A and the wire seal part are formed by separate bodies, and both are formed of a different material. Namely, the wire seal part 7B is formed by a soft material taking into account the work of inserting the electric wires W, and the housing seal part 7A is formed by a comparatively harder material considering only the seal between the housings 4, 6. Accordingly, since the housing seal part 7A and the wire seal part are formed by a quality of material corresponding to the respective qualities of the seals, a waterproof member 7 having a good usability can be formed.

Description follows of a second embodiment of the present invention, with reference to FIG. 11 to FIG. 14 of the drawings.

The waterproof connector 40 of the second embodiment invention refers to a construction of a waterproof member 41 formed of members having different material characteristics respectively between a wire sealing part 41A and a housing sealing part 41B. In this embodiment, when a structural element is the same as that of the aforementioned first embodiment, the same reference numeral is used therein, omitting the description of the operation and the effects.

With regard to the waterproof connector 40 of the second embodiment, integration of the waterproof member 41 and the cover is made by insert-forming or interfitting the waterproof member 41 with the cover 42. Also, the wire sealing part 41A which forms the waterproof member 41 and the housing sealing part 41B are formed as separate components.

The wire seal part 41A has a plate shape with a thick wall-thickness, being arranged so as to cover a window of the cover 42, enabling the wire insertion holes 44 to correspond with the cavities 3. On the other hand, the housing sealing part 41B is fixedly attached, for example by molding and/or adhesive, over its entire periphery to the inside periphery of peripheral wall area 45 of the cover 42. In this case, a waterproof area 46 that corresponds to the locking arm 14 is connected with the housing sealing part 41 B at its upper end.

The wire sealing part 41A and the housing sealing part 41B are formed of materials having characteristics corresponding to each objective. That is, the wire sealing part 41A is formed of a relatively softer elastic material, for example, of NBR (nitrile butadiene rubber), but the hardness is decreased with an increase in the plasticizer used. Furthermore, a reinforcing agent, for example (silica, carbon, etc.) results in increasing the ease of insertion work of wires (not shown in FIG. 11 to FIG. 14) for the wire insertion holes 44. In this case, extremely reducing the hardness leads to poor insertion characteristics due to too much flexibility of rubber and also results in lower sealability. Therefore, the most suitable hardness is preferably about 30–40 Hz (Shore hardness). On the other hand, the housing sealing part 41B is formed of NBR in the same manner as the wire sealing part 41A, but in order to improve sealability, the hardness is made higher than that of the wire sealing part 41A by increasing its reinforcing agent. In this case, the most suitable hardness is, preferably, about 35 to 50 Hz.

In general, with respect to the wire sealing part 41A, soft material is preferred in consideration of wire insertion work, while with respect to the housing sealing part 41B, comparatively harder material is preferred because only consideration of sealability between the housings is necessary. With the present second embodiment, however, the hardness of wire sealing part 41A is set lower than that of the housing sealing part 41B, which is preferably for the above considerations, thereby making it possible to comply with both the improvement in wire (insertion) workability and assurance of sealability between housings.

The technical scope of the present invention is not limited by the above-mentioned mode of operation, and for example, those described as follows are also included in the technical scope of the present invention. Further, the technical scope of the present invention is intended to cover equivalents.

According to the present mode of operation, the housing seal part 7A and the wire seal part are formed of different qualities of the material, but both parts may be formed by the same quality of the material according to an alternative of the present invention. Further, according to another alternative of the present invention, it is unnecessary that the housing seal part and the wire seal part be formed as separate bodies, and they may be formed as a unitary article in which a clearance is provided between both parts and they are combined in thin thickness.

According to the present mode of operation, the waterproof connector 1 houses the terminal fittings 2 of female side, but according to another alternative of the present invention, the terminal fittings 2 of a male side may be housed in the waterproof connector.

According to the present mode of operation, the cover 8A and the waterproof member 7 are unitarily formed by two-color molding, but according to a further alternative of the present invention, the cover and the waterproof member may be respectively configured as separate bodies.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

The present disclosure relates to subject matter contained in priority Japanese Application Nos. HEI 11-319749, filed on Nov. 10, 1999, and HEI 2000-153350, filed on May 24, 2000, which are herein expressly incorporated by reference in their entireties.

What is claimed:

1. A waterproof connector comprising a housing provided with a plurality of cavities capable of housing each of a plurality of terminal fittings connected with one end of electric wires, and a waterproof member assembled to the rear part of the housing;

said waterproof member is provided with a housing seal part for sealing a fitting part with a mating side housing which becomes the fitting partner of said housing, and a wire seal part that seals the respective electric wires, said waterproof member including a cover integrally molded with said housing seal part;

a plurality of electric wire insertion holes which allow the respective electric wires to pass through and surround the electric wires to form a watertight connection are penetratingly formed in said wire seal part;

said housing seal part and said wire seal part are configured as separate members and so that at least one plane that is substantially perpendicular to the axes of said insertion holes passes through said housing seal part and said wire seal part; and a clearance is provided along the entire periphery between the outer peripheral face of said wire seal part and said housing seal part.

2. The waterproof connector according to claim 1, wherein said wire seal part and said housing seal part are formed of members having material characteristics different from each other, and a hardness of said wire seal part is lower than that of said housing seal part.

3. The waterproof connector according to claim 1, wherein said cover includes a recess, said cover capable of hooking on said housing and capable of receiving said wire seal part, and being mountable from the rear side of said housing;

the wire seal part including a large diameter part having a plurality of large diameter holes at the rear side of the said wire seal part, and a small diameter part positioned more toward a front side than said large diameter part, said small diameter part having a plurality of holes with smaller diameters than that of said large diameter holes and being smaller than the outer diameter of the electric wires that are provided in said insertion holes, said clearance is arranged around said small diameter part, and on the other hand, the surrounding of the part where said large diameter part is provided in said wire seal part is received inside said recess in said cover.

4. The waterproof connector according to claim 1, wherein said wire seal part and said housing seal part are formed as separate members.

5. The waterproof connector according to claim 4, wherein said wire seal part and said housing seal part are formed of members having material characteristics different from each other, and a hardness of said wire seal part is lower than that of housing seal part.

6. The waterproof connector according to claim 4, wherein said cover includes a recess, said cover being capable of hooking on said housing and capable of receiving said wire seal part being mountable from the rear side of said housing;

the wire seal part including a large diameter part having a plurality of large diameter holes at the rear side of the said wire seal part, and a small diameter part positioned more toward a front side than said large diameter part, said small diameter part having a plurality of holes with smaller diameters than that of said large diameter holes and being smaller than the outer diameter of the electric wires that are provided in said insertion holes, said clearance is arranged around said small diameter part, and on the other hand, the surrounding of the part where said large diameter part is provided in said wire seal part is received inside said recess in said cover.

7. The waterproof connector according to claim 5, wherein said cover includes a recess, said cover being capable of hooking on said housing and capable of receiving said wire seal part being mountable from the rear side of said housing;

the wire seal part including a large diameter part having a plurality of large diameter holes at the rear side of the said wire seal part, and a small diameter part positioned more toward a front side than said large diameter part, said small diameter part having a plurality of holes with smaller diameters than that of said large diameter holes and being smaller than the outer diameter of the electric wires that are provided in said insertion holes, said clearance is arranged around said small diameter part, and on the other hand, the surrounding of the part where said large diameter part is provided in said wire seal part is received inside said recess in said cover.

8. A waterproof connector comprising:

a housing having a plurality of cavities each capable of receiving a respective one of a plurality of terminal fittings connected with one end of electric wires;

a waterproof member including a cover mountable on a rear end of said housing;

said waterproof member including a housing seal part that forms a seal with a fitting part of a corresponding mating side housing, and a wire seal part that forms a seal with the respective electric wires, said housing seal part being integrally molded with said cover;

said wire seal part including a plurality of electric wire insertion holes extending therethrough in alignment with said cavities, said wire insertion holes permitting respective electric wires to pass therethrough and surrounding the electric wires to form a watertight connection with the wires; said housing seal part and said wire seal part are configured as separate members so that at least one plane that is substantially perpendicular to the axes of said insertion holes passes through said housing seal part and said wire seal part; and a clearance provided in an entire peripheral area between an outer peripheral face of said wire seal part and said housing seal part, wherein said clearance permits outward deformation of said wire seal part to maintain easy insertability of the terminal fittings and wires until insertion of all wires is complete.

9. The waterproof connector according to claim 8, wherein said wire seal part and said housing seal part are formed of members having material characteristics different from each other, and a hardness of said wire seal part is lower than that of said housing seal part.

10. The waterproof connector according to claim 8, wherein said cover includes a recess, said cover being mountable on the rear side of said housing, said recess receiving said wire seal part; and wherein said electric wire insertion holes each include a large diameter part in a rear portion of said wire seal part, and a small diameter part in a forward portion of said wire seal part, said clearance being provided around said forward portion of said wire seal part, and said rear portion of said wire seal part being snugly received within said recess in said cover.

11. The waterproof connector according to claim 10, wherein said rear portion of said wire seal part is removably received within said recess, and said housing seal part is fixedly attached to said cover.

12. The waterproof connector according to claim 8, wherein said wire seal part and said housing seal part are formed of members having material characteristics different from each other.

13. The waterproof connector according to claim 12, wherein said wire seal part has a hardness that is lower than that of said housing seal part.

14. The waterproof connector according to claim 8, wherein said wire seal part and said housing seal part are formed as separate members.

15. The waterproof connector according to claim 14, wherein said wire seal part and said housing seal part are formed of members having material characteristics different from each other, and a hardness of said wire seal part is lower than that of housing seal part.

16. The waterproof connector according to claim 14, wherein said cover includes a recess, said cover being mountable on the rear side of said housing, said recess receiving said wire seal part; and wherein said electric wire insertion holes each include a large diameter part in a rear portion of said wire seal part, and a small diameter part in a forward portion of said wire seal part, said clearance being provided around said forward portion of said wire seal part, and said rear portion of said wire seal part being snugly received within said recess in said cover.

17. The waterproof connector according to claim 16, wherein said wire seal part and said housing seal part are formed of members having material characteristics different from each other.

18. The waterproof connector according to claim 17, wherein said wire seal part has a hardness that is lower than that of said housing seal part.

19. The waterproof connector according to claim 16, wherein said rear portion of said wire seal part is removably received within said recess, and said housing seal part is fixedly attached to said cover.

20. A waterproof connector comprising a housing provided with a plurality of cavities capable of housing each of a plurality of terminal fittings connected with one end of electric wires, and a waterproof member assembled to the rear part of the housing;

said waterproof member is provided with a housing seal part for sealing a fitting part with a mating side housing which becomes the fitting partner of said housing, and a wire seal part that seals the respective electric wires, said waterproof member including a cover integrally molded with said housing seal part;

a plurality of electric wire insertion holes which allow the respective electric wires to pass through and surround the electric wires to form a watertight connection are penetratingly formed in said wire seal part;

said housing seal part and said wire seal part are configured as separate members;

a clearance is provided along the entire periphery between the outer peripheral face of said wire seal part and said housing seal part; and wherein said wire seal part and said housing seal part are formed of members having material characteristics different from each other, and a hardness of said wire seal part is lower than that of said housing seal part.

21. A waterproof connector comprising a housing provided with a plurality of cavities capable of housing each of a plurality of terminal fittings connected with one end of electric wires, and a waterproof member assembled to the rear part of the housing;

said waterproof member is provided with a housing seal part for sealing a fitting part with a mating side housing which becomes the fitting partner of said housing, and a wire seal part that seals the respective electric wires, said waterproof member including a cover integrally molded with said housing seal part;

a plurality of electric wire insertion holes which allow the respective electric wires to pass through and surround the electric wires to form a watertight connection are penetratingly formed in said wire seal part;

said housing seal part and said wire seal part are configured as separate members;

a clearance is provided along the entire periphery between the outer peripheral face of said wire seal part and said housing seal part;

a cover having a recess, said cover being capable of hooking on said housing and capable of receiving said wire seal part, and being mountable from the rear side of said housing; and the wire seal part including a large diameter part having a plurality of large diameter holes at the rear side of the said wire seal part, and a small diameter part positioned more toward a front side than said large diameter part, said small diameter part having a plurality of holes with smaller diameters than that of said large diameter holes and being smaller than the outer diameter of the electric wires that are provided in said insertion holes, said clearance is arranged around said small diameter part, and on the other hand, the surrounding of the part where said large diameter part is provided in said wire seal part is received inside said recess in said cover.

22. A waterproof connector comprising:

a housing having a plurality of cavities each capable of receiving a respective one of a plurality of terminal fittings connected with one end of electric wires;

a waterproof member including a cover mountable on a rear end of said housing;

said waterproof member including a housing seal part that forms a seal with a fitting part of a corresponding mating side housing, and a wire seal part that forms a seal with the respective electric wires, said housing seal part being integrally molded with said cover;

said wire seal part including a plurality of electric wire insertion holes extending therethrough in alignment with said cavities, said wire insertion holes permitting respective electric wires to pass therethrough and surrounding the electric wires to form a watertight connection with the wires;

said housing seal part and said wire seal part are configured as separate members; and a clearance provided along an entire peripheral area between an outer peripheral face of said wire seal part and said housing seal part, wherein said clearance permits outward deformation of said wire seal part to maintain easy insertability of the terminal fittings and wires until insertion of all wires is complete;

wherein said waterproof member further comprises a cover having a recess, said cover being mountable on the rear side of said housing, said recess receiving said wire seal part; and wherein said electric wire insertion holes each include a large diameter part in a rear portion of said wire seal part, and a small diameter part in a forward portion of said wire seal part, said clearance being provided around said forward portion of said wire seal part, and said rear portion of said wire seal part being snugly received within said recess in said cover.

23. A waterproof connector comprising:

a housing having a plurality of cavities each capable of receiving a respective one of a plurality of terminal fittings connected with one end of electric wires;

a waterproof member including a cover mountable on a rear end of said housing;

said waterproof member including a housing seal part that forms a seal with a fitting part of a corresponding mating side housing, and a wire seal part that forms a seal with the respective electric wires, said housing seal part being integrally molded with said cover;

said wire seal part including a plurality of electric wire insertion holes extending therethrough in alignment with said cavities, said wire insertion holes permitting respective electric wires to pass therethrough and surrounding the electric wires to form a watertight connection with the wires;

said housing seal part and said wire seal part are configured as separate members; and a clearance provided along an entire peripheral area between an outer peripheral face of said wire seal part and said housing seal part, wherein said clearance permits outward deformation of said wire seal part to maintain easy insertability of the terminal fittings and wires until insertion of all wires is complete;

wherein said wire seal part and said housing seal part are formed of members having material characteristics different from each other.

* * * * *

UNITED STATES PATENT AND TRADEMARK OFFICE

CERTIFICATE OF CORRECTION

PATENT NO. : 6,450,823 B1 
DATED : September 17, 2002
INVENTOR(S) : T. Ichio et al.

It is certified that error appears in the above-identified patent and that said Letters Patent is hereby corrected as shown below:

Column 12,
Line 31, "claim 8" should be -- claim 19 --.

Signed and Sealed this

Twenty-fourth Day of June, 2003

JAMES E. ROGAN
*Director of the United States Patent and Trademark Office*